United States Patent [19]

Hagel

[11] 4,080,036

[45] Mar. 21, 1978

[54] UNIVERSAL SAFETY PLUG

[76] Inventor: Henry J. Hagel, 7848 Tessman Dr., Brooklyn Park, Minn. 55445

[21] Appl. No.: 794,817

[22] Filed: May 9, 1977

[51] Int. Cl.[2] ..... H01R 13/58

[52] U.S. Cl. ..... 339/103 R; 339/176 R; 339/219 R; 339/272 A

[58] Field of Search ..... 339/103 R, 103 B, 103 C, 339/103 M, 104, 107, 176 R, 191 R, 195 R, 237, 219 R, 220 R, 220 T, 272 A, 272 R, 276 R

[56] References Cited

U.S. PATENT DOCUMENTS

| | | | |
|---|---|---|---|
| 2,490,153 | 12/1949 | O'Donnell | 339/272 A |
| 2,865,013 | 12/1958 | Kazanowski | 339/219 R X |
| 3,039,074 | 6/1962 | Koenig | 339/176 X |
| 3,562,701 | 2/1971 | Orr | 339/272 A |

*Primary Examiner*—Roy Lake
*Assistant Examiner*—DeWalden W. Jones

[57] ABSTRACT

A safety plug that includes an elongated neck portion having externally accessible means seated thereto to aid against the electrical wire and thereby substantially reduce or eliminate the tendency of the same to be prematurely pulled loose from the plug connection, a non-conductive material may be employed in manufacturing the plug thereby further enhancing its utility.

10 Claims, 4 Drawing Figures

UNIVERSAL SAFETY PLUG

BACKGROUND OF THE INVENTION

This invention relates to a safety feature or locking member for use in connection with a male electrical plug or female receptacle; more particularly, to a device whereby the electrical cord is securely fastened against the plug body so that the same will not be easily removed from the connector terminals in the plug.

The prior art teaches a variety of different plugs, for example, as disclosed in U.S. Pat. Nos. 2,711,521; 3,020,578; 3,141,718; 3,354,420; 3,402,382; 3,663,924; 3,829,819; 3,950,069; and others.

SUMMARY OF THE INVENTION

It is accordingly an object of the instant invention to provide for a new and improved safety plug.

It is another object to provide for one that effectively reduces movement of the electrical wire within the plug body.

It is a further object to provide for the same at relatively little cost thereby making it generally available.

These and other objects and advantages of the invention will become more apparent from a consideration of the following detailed disclosure and claims and by reference to the accompanying drawings, in which:

Figure 1:
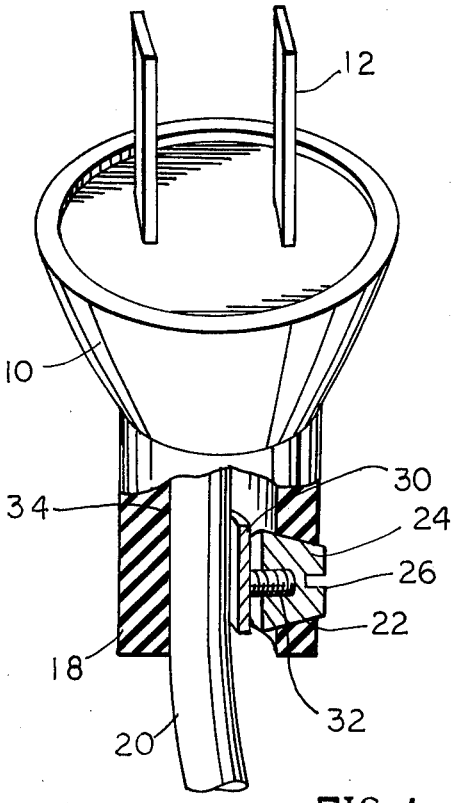
FIGS. 1–2 are elevational views partly in section.
Figure 2:
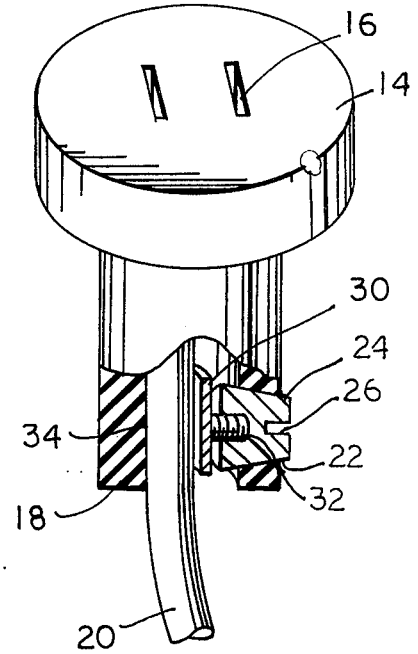
Figure 3:
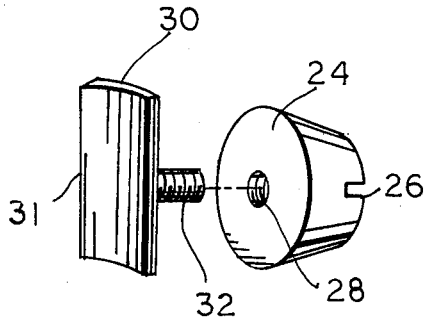
FIG. 3 is a perspective view of a portion of the device.
Figure 4:
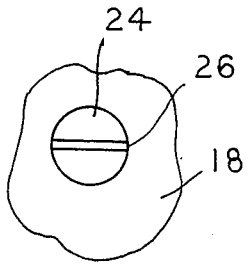
FIG. 4 is a top plan view of a portion of the device.

Broadly speaking, the instant invention includes the provision of an electrical connector for reducing the tendency of an electrical wire to be removed therefrom, comprising a body having a cavity and means for communicating with an electrical wire therein, a hollow open neck portion having at least one open end depending from the body, the neck portion defining an aperture and adapted to receive a wire therethrough, a frusto conical member communicating with the aperture and rotatable therein, a slotted groove at one end of the member, an internally threaded recess at the opposite end of the member, a second member having at least one annular surface, an externally threaded shaft depending therefrom, the shaft adapted to mate with the recess whereby when the first member is rotated the second member is urged across the diameter of the neck portion.

DETAILED DISCLOSURE

Referring more particularly to the drawing, there is shown a conventionally shaped male plug body 10 having a pair of contacts 12 depending therefrom or a female receptacle body 10 with a pair of recesses 16 therein. Each body 10 or 14 will have a neck portion 18 depending therefrom opposite shaft 32 depending therefrom communicates with the recess 28. The member 30 is generally elongated and has a concave-concex outer opposing surface; the concave surface 31 adapted to engage and exert pressure against the wire 20 thereby pressing the same backward against the interior wall 34 of the neck 18 and reducing the tendency of it to move. The shaft 32 generally being substantially perpendicular thereto. Generally, the member 24 is placed within the hollow neck 18 prior to the insertion of the wire 20 therethrough into the body (10 or 14) inasmuch as it is the end of the member 24 having the smaller diameter which protrudes outward through the aperture 22 such that a tool such as a screw driver or the like may be applied to the groove 26 to rotate the member 24, cause the shaft 32 to be rotated thereoutof and thence the member 30 towards the wire 20.

Since it is obvious that numerous changes and modifications can be made in the above-described details without deparing from the spirit and nature of the invention, it is to be understood that all such changes and modifications are included within the scope of the invention.

I claim:

1. An electrical connector for reducing the tendency of an electrical wire to be removed therefrom, comprising a body having a cavity and means for communicating with an electrical wire therein, a hollow open neck portion having at least one open end depending from said body, said neck portion defining an aperture and adapted to receive a wire therethrough, a frusto conical member communicating and rotatable therein with said aperture, a slotted groove at one end of said member, an internally threaded recess at the opposite end of said member, a second member having at least one annular surface, an externally threaded shaft depending therefrom, said shaft adapted to mate with said recess whereby when said first member is rotated said second member is urged across the diameter of said neck portion.

2. The connector as defined in claim 1, wherein said body is a male plug.

3. The connector as defined in claim 1, wherein said body is a female receptacle.

4. The connector as defined in claim 1, wherein said second member has opposing convex-concave surfaces.

5. The connector as defined in claim 1, wherein said shaft is substantially perpendicular to said second member.

6. The connector as defined in claim 1, wherein rotation of said first member in one direction causes said shaft to be displaced therefrom.

7. The connector as defined in claim 1, wherein first member is tapered in the direction of said aperture.

8. The connector as defined in claim 1, wherein said neck portion is constructed of a flexible material.

9. The connector as defined in claim 1, wherein said neck portion and said body are unitary.

10. The connector as defined in claim 1, wherein said neck portion is removably affixed to said body.

* * * * *